US012013200B2

(12) United States Patent
von Mueller et al.

(10) Patent No.: US 12,013,200 B2
(45) Date of Patent: Jun. 18, 2024

(54) FIREARM TRACKING, COMMUNICATION, AND MONITORING APPARATUS AND SYSTEM

(71) Applicants: Clay von Mueller, San Diego, CA (US); Jeff Wilson, Burlington (CA)

(72) Inventors: Clay von Mueller, San Diego, CA (US); Jeff Wilson, Burlington (CA)

( * ) Notice: Subject to any disclaimer, the term of this patent is extended or adjusted under 35 U.S.C. 154(b) by 0 days.

(21) Appl. No.: 17/143,889

(22) Filed: Jan. 7, 2021

(65) Prior Publication Data

US 2022/0228829 A1 Jul. 21, 2022

Related U.S. Application Data

(60) Provisional application No. 62/938,538, filed on Jan. 7, 2020.

(51) Int. Cl.
*F41A 17/06* (2006.01)
*F41A 19/01* (2006.01)

(52) U.S. Cl.
CPC ..... *F41A 17/063* (2013.01); *F41A 19/01* (2013.01)

(58) Field of Classification Search
CPC ..... F41A 17/063; F41A 19/01
See application file for complete search history.

(56) References Cited

U.S. PATENT DOCUMENTS

| | | | | |
|---|---|---|---|---|
| 4,541,191 | A * | 9/1985 | Morris | F41B 15/02 42/1.01 |
| 8,464,451 | B2 * | 6/2013 | McRae | F41A 9/53 42/122 |
| 9,273,918 | B2 * | 3/2016 | Amit | F41A 19/01 |
| 9,546,835 | B2 * | 1/2017 | Efremkina | G01S 19/14 |
| 10,254,066 | B1 * | 4/2019 | Petersen | F41A 9/29 |
| 11,156,419 | B1 * | 10/2021 | Wang | F41G 1/35 |
| 2010/0196859 | A1 * | 8/2010 | Saugen | F41G 1/02 434/11 |
| 2011/0072703 | A1 * | 3/2011 | Ferrarini | F41A 19/01 42/1.01 |

(Continued)

*Primary Examiner* — Joshua E Freeman

(57) ABSTRACT

Firearms being used by non-authorized individuals have been the cause of the death of many innocent people. Guns and rifles are relatively easy to obtain illegally though black markets or by stealing from relatives and acquaintances of registered firearm owners and there is no adequate methods of restricting their operation after they are not controlled by the owner. The current disclosure describes an apparatus and system for remotely monitoring the location, movement and operational status of a firearm and report the status to the firearm owner. Alternatively, the system will track the firearms location and status and report to a central authority when the firearm is fired. This method of operation can be used to notify a central authority to provide backup for an officer under fire. Shots fired and shots heard are detected using acoustic time of flight and sound signature analysis. The detection apparatus being contained within the firearm. In addition, the system uses multiple communication channels to connect with the central authority or firearm owner, including cellular, Wi-Fi, Bluetooth, Lora wan. These communication channels may send firearm discharge information through the cellular or land line 911 system.

7 Claims, 1 Drawing Sheet

(56) References Cited

U.S. PATENT DOCUMENTS

| | | | | |
|---|---|---|---|---|
| 2013/0040268 | A1* | 2/2013 | Van der Walt | F41J 5/02 434/16 |
| 2015/0211828 | A1* | 7/2015 | Lupher | F41A 17/06 42/69.01 |
| 2015/0369554 | A1* | 12/2015 | Kramer | H04N 9/806 386/227 |
| 2016/0033221 | A1* | 2/2016 | Schmehl | F41A 33/00 42/90 |
| 2016/0190859 | A1* | 6/2016 | Blum | F41C 33/029 348/372 |
| 2017/0248388 | A1* | 8/2017 | Young | F41A 17/063 |
| 2019/0003804 | A1* | 1/2019 | Deng | F41A 35/00 |
| 2019/0186875 | A1* | 6/2019 | Pirkle | F41A 19/01 |
| 2019/0281259 | A1* | 9/2019 | Palazzolo | H04N 7/183 |
| 2019/0293388 | A1* | 9/2019 | Barrett | F41G 3/2672 |
| 2020/0003511 | A1* | 1/2020 | Deng | F41A 17/06 |
| 2020/0011629 | A1* | 1/2020 | Deng | G01S 19/18 |
| 2020/0355456 | A1* | 11/2020 | Deng | H04N 23/66 |
| 2021/0199408 | A1* | 7/2021 | Reed | G06N 3/08 |

* cited by examiner

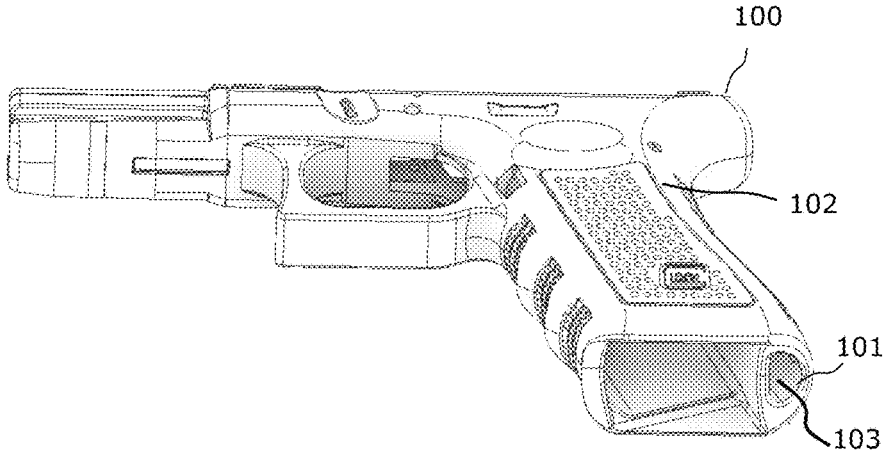
FIG. 1
FIG. 2
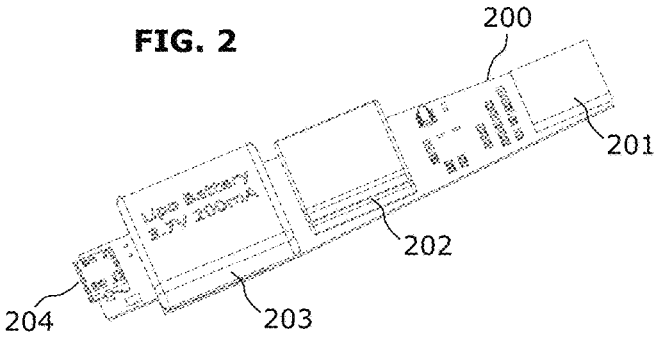
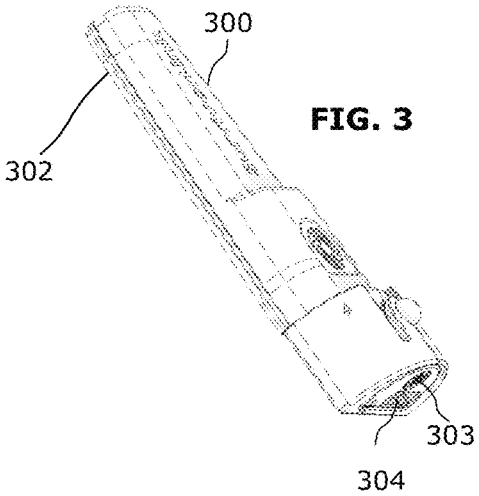
FIG. 3
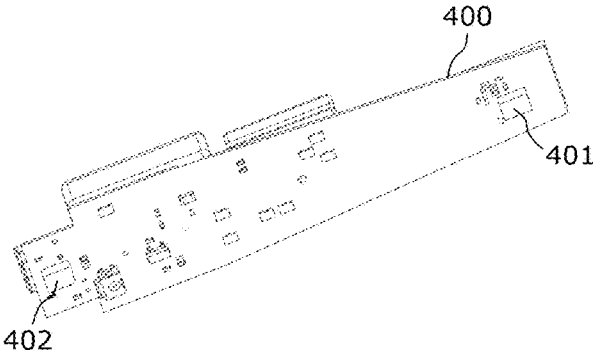
FIG. 4

FIREARM TRACKING, COMMUNICATION, AND MONITORING APPARATUS AND SYSTEM

PRIORITY CLAIM

Priority is claimed to 62/938,538 FIREARM TRACKING, COMMUNICATION, AND MONITORING APPARATUS AND SYSTEM

CROSS-REFERENCE TO RELATED APPLICATIONS

Not Applicable

STATEMENT REGARDING FEDERALLY SPONSORED RESEARCH

Not Applicable

PARTIES TO A JOINT RESEARCH AGREEMENT

Not Applicable

FIELD OF THE INVENTION

The field of the present invention generally relates to the detection and tracking of firearm location and firearm discharge events and reporting such data through wireless communications to mobile phone, cloud based and dedicated internet-based reporting systems.

BACKGROUND OF THE INVENTION

Gun shoot detection systems exist for determining the location of a firearm discharge and report to a central authority. These systems are based on sensors placed on lighting posts and other structures throughout the area to be served by the system. These systems use triangulation between multiple sensors to determine the firearm discharge location. These systems report shot detection data to a central authority for further investigation and possible dispatch of authorities to the location of the intendent. These systems provide valuable assistance in the detection and location of shots fired in areas where they are installed, yet they are limited in installation to areas with high crime rates, not homes and schools.

Weapon detection systems are in use at court houses, police stations, airports along with many other locations to detect illegal firearms for the protection of the general population. The design and goal of these systems is to detect all firearms, yet in some situations with individuals with concealed firearms, it is desirable that their firearms do not trigger these detection systems. One example is an undercover police officer searching for a fugitive that maybe tipped off by the triggering of the detection system.

Gun safes and gun locks provide some protection for securing firearms from unauthorized use, yet these passive systems have been shown to be vulnerable to attack, enabling unauthorized individuals to steal firearms and use them to cause many deaths.

Biometric devices, including fingerprint sensors can be built into the grip of firearms to prevent unauthorized, disabling the firing mechanism except for authorized users. The problem with these devices is that fingerprint sensors are subject to false readings if the finger is wet or covered with a glove. One false reading could prevent an authorized user to use the firearm when lives are at stake.

All of the weapon and shot fired detection systems cited in [0007-0010] are used to protect against unauthorized use of firearms and do not address the need to detect the use of firearms by authorized individuals in performing their duties. When a police officer draws and discharges their firearm there is a need to record the event and inform others that a firearm discharge has occurred so that backup support can be dispatched in a timely manner.

SUMMARY OF THE INVENTION

Disclosed herein is a firearm location and shots fired detection system which overcome at least one of the deficiencies of the prior art.

In operation a device is attached each of the firearms to be monitored containing a sensor capable of detection a shot fired event detector, a location (GPS) sensor, a communication method, a battery and a controller.

During periods of no shot detection the device attached to the firearm periodically communicates with a remote server, indication the status and location of the firearm. In one case, the method of communication is a cell-based LTE data connection. When a shot fired event is detected, a message is immediately sent to the remote server. The server then sets an alarm condition, notifying the appropriate authorities with the alarm event and the firearms location.

In another case the method of communication is a Bluetooth connection to a police officer's cell phone. An app on the cellphone monitors the status of the firearm and provides the programed response if required. The device mounted on the firearm can provide additional information to the app, including and not limited to, the physical orientation and movement of the firearm, such as the firearm is pointed down as in the case of being holstered or being drawn and leveled as would be the case prior to firing.

In all the afore mentioned summaries of the current invention the ability to accurately detect shots fired and shots detected events is critical. Acceleration and orientation provided by the devices motion sensors attached to the firearm is not adequate to detect shots fired by another firearm, and in detecting shots fired by the monitored firearm, the acceleration caused by a weapon discharge is similar in magnitude to the firearm being held while running.

The primary method of detecting local and remote shots fired and shots events is using two acoustic sensors attached to the firearm. In the case of a Glock 17 or 19 handgun, these two sensors are placed within the grip of frame of the gun. One sensor located near and acoustically coupled to the barrel while the other is located near the bottom of the grip ported to the outside of the gun. Each sensor is isolated from the other with an acoustic dampener placed within the grip between the two sensors. In the case of the Glock 17 and 19 the grip has a cavity suitable for sliding in the described firearm monitor device, requiring no modification to the firearm.

The two acoustic sensors are used to measure the time differential between sound coming from the barrel close to the grip and the barrel muzzle to determine if the discharge was local to the gun or some distance away, indicating shots fired and shots heard. In addition to the time differential between the sensors, the waveform frequency and cadence of the event is analyzed to discriminate between a shot fired and other events such as a door being slammed. Advanced waveform analysis can be used to determine what class and type of firearm is being discharged.

In addition to the primary method of detecting shots described in [0017], an inertia and magnetic sensor are employed to detect the direction of the discharge for later forensic review.

Also disclosed is a gun storage system with improved security. A firearm with this monitoring device and enabled with cell-based communication can be used to alert the firearm owner when is has been moved from its storage location via text message or other methods. In the case of a firearm placed in a gun safe, RF communication is disrupted by the safes steel structure and the periodic communication attempts from the device attached to the firearm are not detected by the remote server. In essence, no news is good news. When the firearm is removed from the safe the device connects to the remote server indicating the firearm has been moved and alerting the firearm owner of the movement.

Also disclosed is a gun storage system with improved security where the firearm is not placed in a gun safe and may be secured with a gun lock or unsecured. The device attached to the firearm periodically communicates to the remote server detailing the firearms location and orientation. Using a phone-based app the owner of the firearm requests notification if the firearm is moved. If the firearm condition changes to the requested notification parameters an alarm is sent to the app and a text message is sent to the phone of the owner.

A potential drawback with this wireless based detection system are the charges related to the communication carrier. GSM network connections have costs that could be prohibitive where there are many firearm monitoring devices or for a private party that wants to monitor one firearm that rarely is removed from a gun safe. In these cases, the 911 emergency service can be used when the firearm maybe used to cause immediate harm. In this case the firearm mounted device would dial 911, which does not require an activated account, and deliver an alert message as to the firearms location and status.

Also disclosed is a device attached to a firearm the processes acoustic data from one or more acoustic sensors to determine if the acoustic data representative of gun shot, and further determines if the gun shot fired acoustic signature data represents one of a number of firearms. A signature database containing signatures from one or more firearms stored in the device attached to the phone. In addition to locally comparing the acoustic data signatures the device attached to the firearm may send the acoustic data to the remote server for further analysis and archrival storage.

In addition the device attached to the firearm may send acoustic data in addition to shoot detection signature data for further analysis. Acoustic data local to the firearm including speech, sirens and other background audio data are send to the remote server. The remote server processes this data and displays on a dashboard. In addition, the audio data is selectively forwarded to a central authority, such as a police dispatch office ort the owner of the firearm.

Also disclosed is a firearm location and shots fired detection system that employs other low-cost communication methods such as Lora wan, long range Bluetooth, Wi-Fi and mesh networks. In one such case community service vehicles are equipped with Lora wan to GSM gateways. Each gateway monitors for the firearm attached device and when such a device is detected, relies the device communication to the remote server.

BRIEF DESCRIPTION OF THE DRAWINGS

These and further features of the present invention will be apparent with reference to the following description and drawings, wherein:

FIG. 1 is an perspective view of a Glock 17 hand gun used to describe the current invention;

FIG. 2 is a perspective top view of shot detection device hardware PCB board;

FIG. 3 is a perspective view of shot detection device hardware encased, ready for installation not the handgun of FIG. 1;

FIG. 4 is a perspective bottom view of shot detection device hardware PCB board of FIG.

It should be understood that the appended drawings are not necessarily to scale, presenting a somewhat simplified representation of various preferred features illustrative of the basic principles of the invention. The specific design features of the bilge pump switch as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the bilge pump switches illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the firearm location and shots fired detection system disclosed herein. The following detailed discussion of various alternative and preferred embodiments will illustrate the general principles of the invention. Other embodiments suitable for other applications will be apparent to those skilled in the art given the benefit of this disclosure.

Referring now to the drawings, FIGS. 1 to 4 illustrate a firearm location and shots fired detection system according to the present invention. The illustrated Glock 17 handgun 100 incorporates a open space in the hand grip 101, into which the firearm location and shots fired detection module 300 is inserted.

FIG. 2 is the top view of the firearm location and shots fired detection PCA module contained within the firearm location and shots fired detection enclosure 300. The firearm location and shots fired detection PCA module includes a controller and wireless communications method 201, a GPS sensor 202, a battery 203, and an acoustic sensor 204.

FIG. 3 is the firearm location and shots fired detector enclosure 300, which slide into the grip of the Glock 17 at 103. The acoustic detector ports 302, 304 in the detector enclosure 300 are located near the gun firing chamber 102 and the base of the handgrip 101, when slid into the hand grip cavity 103, aligns with the acoustic sensors 401 and 402. Acoustic sensor 401 aligns with port location 302, while sensor 402 aligns with port location 304.

FIG. 4 is the bottom view of the firearm location and shots fired detection PCA module contained within the firearm location and shots fired detection enclosure 300 showing the two acoustic sensors 401, 402.

In one preferred embodiment, a potential shot fired event, which maybe a gun discharge or another noise source such as a door being slammed or a fire siren, triggers a timer which measure the time between the two acoustic sensors being triggered. In addition, the trigger event causes the output of each acoustic sensor to be sampled and recorded using a high speed A2D converter. The data is logged for a period corresponding to the cadence of a firearm being discharged, of ½ second. The logged data is processed and compared to the cadence of a shot being fired, and if a match is found a shot detected alarm is set. The time between the two acoustic sensors being triggered and the order in which the sensors are triggered are used to evaluate if the shot originated in the firearm being monitored or remotely from another firearm. The acoustic sensor 102 located near the firing chamber and the acoustic sensor located at the base of the grip 101 will see a time differential of −440 uS differential between the two acoustic sensors being triggered during a discharge form the firearm attached to the monitoring device. In addition, the acoustic sensor located at 102 will trigger first. For a remote gunshot the acoustic sensor 402 located at the base of the gun grip 103 will trigger first.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An apparatus comprising:

a module inserted into a grip of a handgun wherein multiple acoustic sensors are present and a first sensor of the multiple acoustic sensors is located near a firing chamber, a second sensor of the multiple acoustic sensors is ported through a base of the grip, and wherein a detected presence of the acoustic events from the multiple acoustic sensors indicates a weapon has been discharged.

2. The apparatus of claim 1, further comprising: a processor configured to process sensor data generated by one or more of the multiple acoustic sensors, and process acoustic signals that identify a discharge of the weapon.

3. The apparatus of claim 1, further comprising: a processor configured to process sensor data generated by at least one of the multiple acoustic sensors, and process acoustic signals that identify a shot heard event external to the weapon.

4. The apparatus of claim 1, wherein the apparatus is further configured to process geo-location data responsive to the weapon being discharged.

5. The apparatus of claim 4, wherein the geo-location data is acquired as global positioning system (GPS) data from an external mobile device.

6. The apparatus of claim 1, wherein the processor is further configured to generate a message responsive to the weapon being discharged as detected by the one or more of the multiple acoustic sensors which detects when the weapon has been discharged.

7. The apparatus of claim 1, wherein the processor receives data from the multiple acoustic sensors and generates an alert message to request additional police backup.

* * * * *